US005941466A

United States Patent [19]

Alba et al.

[11] Patent Number: 5,941,466

[45] Date of Patent: Aug. 24, 1999

[54] PROCESS AND DEVICE FOR CHOPPING A BODY OF SOLID EXPLOSIVES, ESPECIALLY COMPOSITE ROCKET FUELS

[76] Inventors: Helmut Alba, Hinter den Kirschkaten 32, D-23560 Lübeck; Juergen Wilhelm, Mfada-Boleslzven-Strasse, D-17036, Naubrandenburg, both of Germany

[21] Appl. No.: 08/836,432

[22] PCT Filed: Oct. 19, 1995

[86] PCT No.: PCT/EP95/04104

§ 371 Date: May 9, 1997

§ 102(e) Date: May 9, 1997

[87] PCT Pub. No.: WO96/14961

PCT Pub. Date: May 23, 1996

[30] Foreign Application Priority Data

Nov. 10, 1994 [DE] Germany ..... 44 40 208

[51] Int. Cl.[6] ..... B02C 19/18

[52] U.S. Cl. ..... 241/1; 83/53; 241/301

[58] Field of Search ..... 83/177; 451/53, 451/75; 241/1, 301

[56] References Cited

U.S. PATENT DOCUMENTS 2,092,083 9/1937 Ogle et al. .
5,001,870 3/1991 Yokota et al. .

FOREIGN PATENT DOCUMENTS 0562764 9/1993 European Pat. Off. .
0594091 4/1994 European Pat. Off. .
8807176 7/1988 Germany .
4221666 1/1994 Germany .

OTHER PUBLICATIONS

WO, A, 94 00275 Alliant Techsystems Inc. Jan. 6, 1994.
Database WPI Week 8903 Derwent Publications Ltd., London, GB; AN 89–023333 see abstract. Dec. 27, 1988.
Database WPI Week 9310 Derwent Publications Ltd., London, GB; AN 93–077572 & DE, A,41 28 703 (RATH D), Mar. 4, 1994 see abstract.
Database WPI Week 9128 Derwent Publications Ltd., London, GB; AN 91–022301 abstract Jun. 1991.

*Primary Examiner*—Mark Rosenbaum
*Attorney, Agent, or Firm*—Jordan and Hamburg LLP

[57] ABSTRACT

A method for chopping a body consisting of explosives is described, by which a high-pressure water jet emerging from a nozzle is directed against the body of solid explosive and in which the nozzle and the body carry out a movement relative to each other during the chopping. Preferred fields of use are composite rocket fuels. There is also described a device for carrying out the process, in which the body of composite rocket fuel to be decomposed or divided into portions is secured on a chopping bench, and a nozzle fastened to a nozzle holder for the high-pressure water jet as well as at least one means for producing a relative movement serving as chopping advance movement between the nozzle and the body of composite rocket fuel are provided.

15 Claims, 4 Drawing Sheets

PROCESS AND DEVICE FOR CHOPPING A BODY OF SOLID EXPLOSIVES, ESPECIALLY COMPOSITE ROCKET FUELS

BACKGROUND OF THE INVENTION

The present invention relates to a process and device for chopping a body of solid explosives.

Solid explosives are used in relatively large quantities or numbers in solid rockets and engines of all kinds, such as, for example, ground-to-air, ground-to-ground and air-to-air rockets. Such rockets and engines are contained in large numbers in warehouses for storage and are to be fed for decomposing, recycling or destruction. For this, safe, ecologically clean and efficient technologies are required. The composite fuels used for solid rockets contain a high proportion of 60% to 80% of an oxidizing agent and of aluminum in powdered form within a range of 5 to 10%. As oxidizing agent, ammonium perchlorate, potassium perchlorate or ammonium nitrate is generally used. In this connection, it is to be noted that at 240° C. ammonium perchlorate ($NH_4ClO_4$) for instance gives off chlorine as a strong respiratory poison and oxygen to support combustion. In addition to this, there is the problem in the case of solid fuels that they are capable of becoming statically charged when worked on. The static charges can lead to voltages of up to 1000 V. The electrical discharges, which necessarily take place in this connection can, to be sure, not ignite the solid fuel in view of their short life, but they can, however, ignite the dust or powder produced in the event of dry working, such as sawing, grinding, etc., which dust or powder in its turn can lead to the igniting of the solid fuel. Furthermore, solid rocket fuels have high sensitivity to impact and friction.

For the disposal of ammunition and solid fuels of rockets of small range, use has been made up to now of "open air" burning for a limited time of small amounts of fuel, pursuant to exceptions granted by the competent authorities. Due to the relatively large number of solid rockets and engines as well as the large weight of monolithically cast bodies of solid fuel, "open air" burning is therefore out of the question also from an ecological standpoint. Therefore, a treatment of the solid fuels, in which reactions which represent a danger to man and environment can be excluded, must be assured.

Burning the solid rocket fuel without previously dividing it into small portions is not possible, particularly in the case of rocket engines of long-range rockets, due to the high mass of burnable substance in the total mass of the rocket.

At the present time, no technologies for the decomposing or dividing into portions of composite rocket fuels are known. This may be due, inter alia, to the fact that the decomposing/destruction of rockets or their engines has not been necessary in the recent past.

The object of the present invention therefore is to provide a process for the chopping of solid explosives and a device for carrying out the process, with which larger monolithic bodies of solid fuels, particularly composite rocket fuels, can be decomposed or divided into smaller parts.

SUMMARY OF THE INVENTION

This objective is accomplished by a process and a device for carrying out the process for the chopping of a body of solid explosives, in particular composite rocket fuels, a high-pressure in which water jet emerging from a nozzle is directed against the body of solid explosive, the nozzle and the body of solid explosive carrying out, at the same time, a movement relative to each other during the chopping. The use of a high-pressure water jet as chopping tool effectively avoids the dangerous thermal effects, which take place upon other mechanical methods of separation, in the manner, for instance, that the thermal energy produced upon the chopping is led away by the water, which acts as coolant. Another important advantage is that the process can be carried out under conditions of ambient pressure and at the same time undesired ignition of the solid fuel can be prevented.

In a preferred embodiment, the process for chopping bodies consisting of solid explosives is applied to a body of composite rocket fuel. In order to increase the speed upon the chopping of the body of solid composite rocket fuel, abrasive particles are added to the high-pressure water jet.

The chopping advance movement can be realized by fixing the position of the nozzle and moving the body of composite rocket fuel, by moving the nozzle and fixing the body, or by moving both the body and the nozzle.

In another preferred embodiment, a chopping advance movement takes place around at least two axes in order to be able to obtain curved or inclined chopped surfaces. Depending on the nature of the composite rocket fuel, the high-pressure water jet emerges from the nozzle with a pressure within the range of 30 to 120 MPa.

If the composite rocket fuel is contained within a casing, then, in a further embodiment, this can be effected by high-pressure water-jet chopping within the casing between the inner surface of the casing and the outer surface of the composite rocket fuel, so as to scoop the body of composite rocket fuel out of the casing. The scooping is possible without cutting through the body of fuel and casing since a binder is present between the body and the casing.

Since the dividing of composite rocket fuels into portions falls within the technologies of potential danger, it is possible, in another preferred embodiment, for the chopping advance movements of nozzle and/or body of composite rocket fuel as well as selected parameters of the high-pressure water jet, such as pressure of emergence, diameter of the jet, focusing of the jet, proportion of abrasive particles in the high-pressure water jet, etc. to be remote-controlled.

An inventive device for the carrying out of the process for the chopping of a body consisting of explosives has a chopping bench, on which a body of composite rocket fuel is secured, the securing means varying, depending on the size of the body of composite rocket fuel to be divided into portions, a nozzle fastened to a nozzle holder for a high-pressure water jet, and at least one means for producing a relative movement, serving as chopping advance movement, between the nozzle and the body of composite rocket fuel. The device is developed in such a manner that a dividing of the body of composite rocket fuel into smaller parts can be effected by the high-pressure water jet in different perpendicular, horizontal, inclined or curved surfaces.

In a preferred embodiment, the body is fixed in position on the chopping bench, that is, either clamped by a fastening device in the case of a smaller body or resting on the chopping bench in the case of larger body, and the nozzle holder is movable, it being displaceable or swingable or displaceable and swingable.

In another preferred embodiment, the components of the device carrying out the chopping advance movements as well as the variables influencing the parameters of the high-pressure water jet can be remotely controlled.

If abrasives are added to the high-pressure water jet in order to increase the speed of chopping, water then serving as carrier for the abrasives, a nozzle of wear-resistant material is preferably used in order to increase its life.

Further advantages and features of the invention will now be described on the basis of two embodiments, with reference to the drawings, in which like reference numerals designate the same elements.

DETAILED DESCRIPTION OF THE DRAWINGS

Figure 1A:
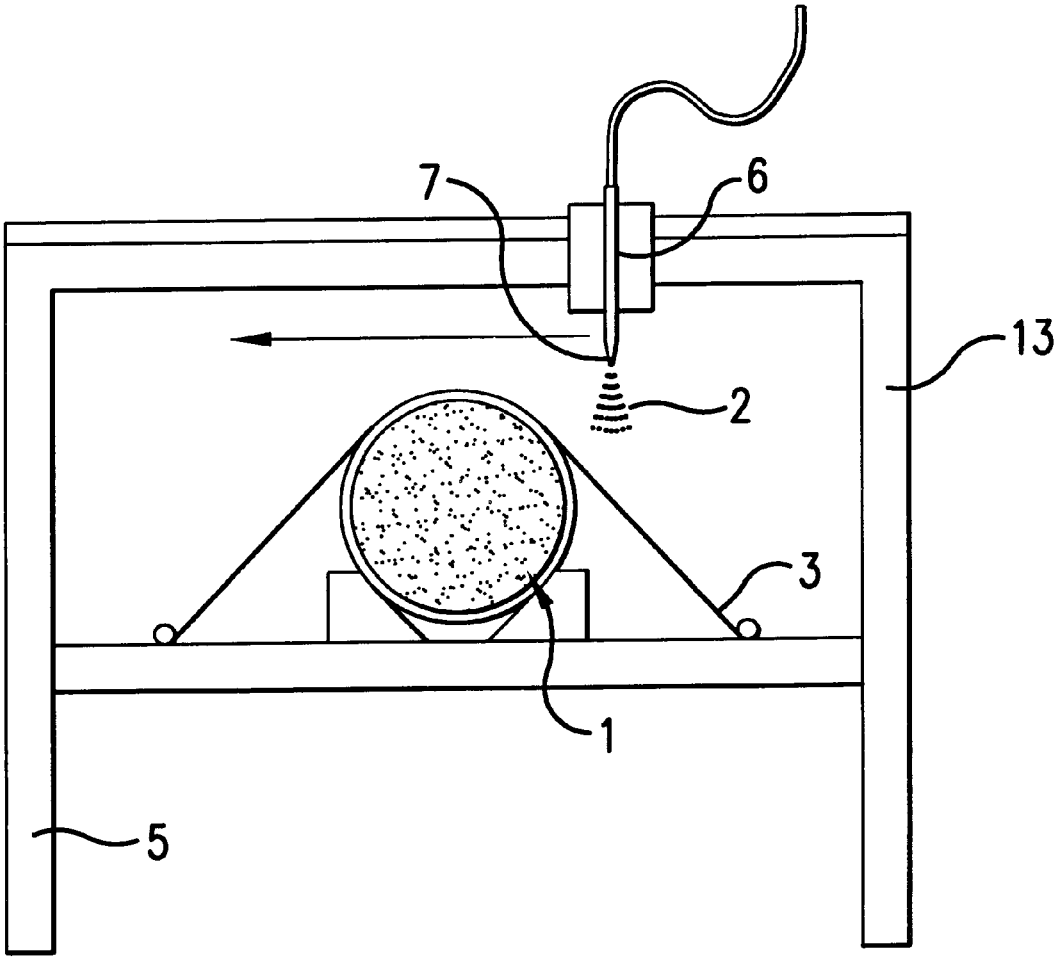
FIG. 1*a*) is a side view, with the body, which is to be chopped, clamped on the chopping bench and having a nozzle holder, which is arranged displaceable on a frame.
Figure 1B:
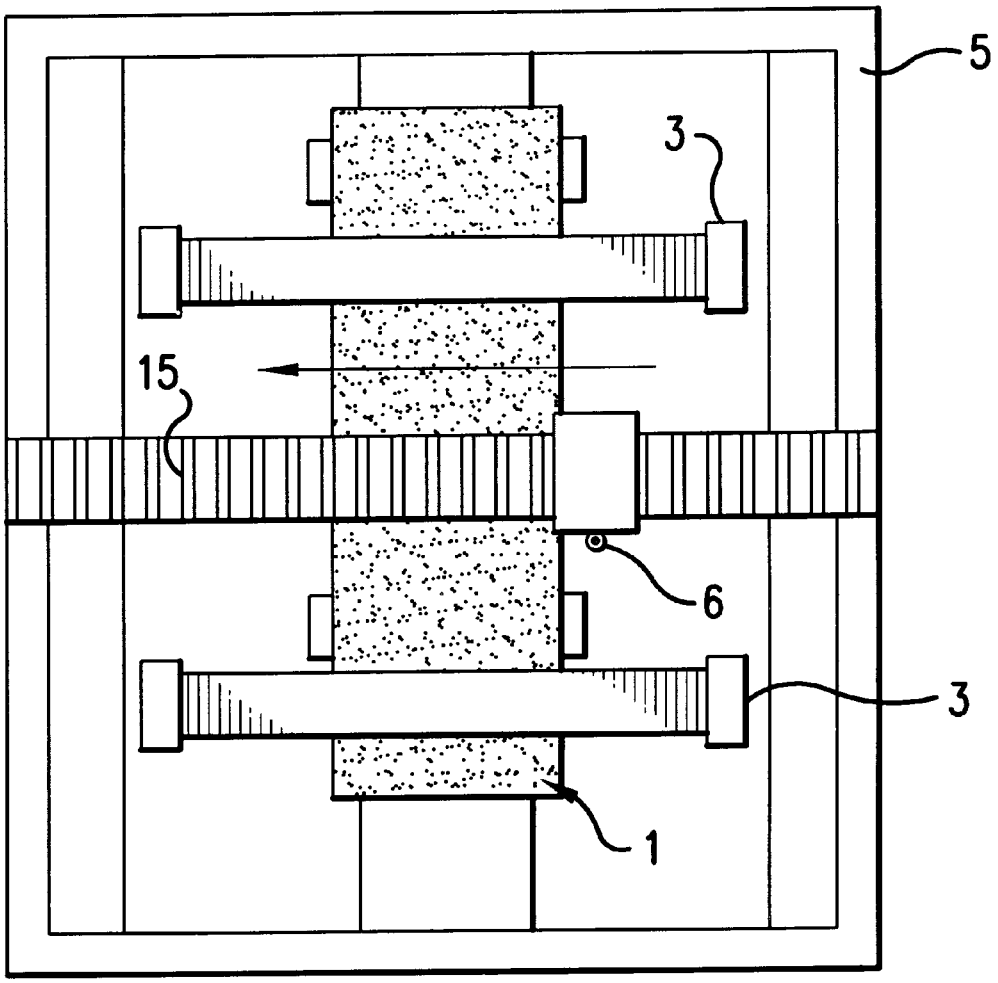
FIG. 1*b*) is a top view of the arrangement shown in FIG. 1*a*)

FIG. 1*a*) is a side view of a chopping bench 5 with a body 1 of composite rocket fuel clamped thereon by means of clamping straps 3, the body 1 being a relatively small mass of fuel. On the chopping bench 5, on each longitudinal side, there is arranged a guide frame 13, over which there extends a beam 15, on which the nozzle holder 6 having the nozzle 7 for the high-pressure water jet 2 is displaceably arranged, the beam 15 being displaceable in the longitudinal direction of the body 1 of composite rocket fuel. The beam 15 for the fastening of the displaceable nozzle holder 6 for the nozzle 7 is shown in FIG. 1*b*). Due to the fact that the nozzle holder 6 is displaceable by a first drive device which, for example, is a stepping motor controlled by an associated control means, both on the beam in transverse direction to the guide frame 13 and also together with the beam in longitudinal direction on the guide frame 13 by a second drive device, cuts can be made both in the transverse direction of the body 1 of composite rocket fuel and in its longitudinal direction parallel to the lengthwise axis, or, by simultaneous movement of the nozzle holder 6 on the beam 15 and on the guide frame 13, in oblique surfaces. In this way, a division into portions of the monolithic body 1 of composite rocket fuel into units of any desired size can be effected.

In a simplified embodiment, it is, however, also possible to dispense with separate drives for the beam in longitudinal direction of the body 1 of composite rocket fuel and to carry out cuttings with the high-pressure water jet 2 only perpendicular to the longitudinal axis of the fuel.

When relatively long cylindrical bodies 1 of composite rocket fuel are concerned, it is necessary to provide several clamping straps 3, spaced from each other in the lengthwise direction of the body 1, and to secure them to the chopping bench 5.

Figure 2A:
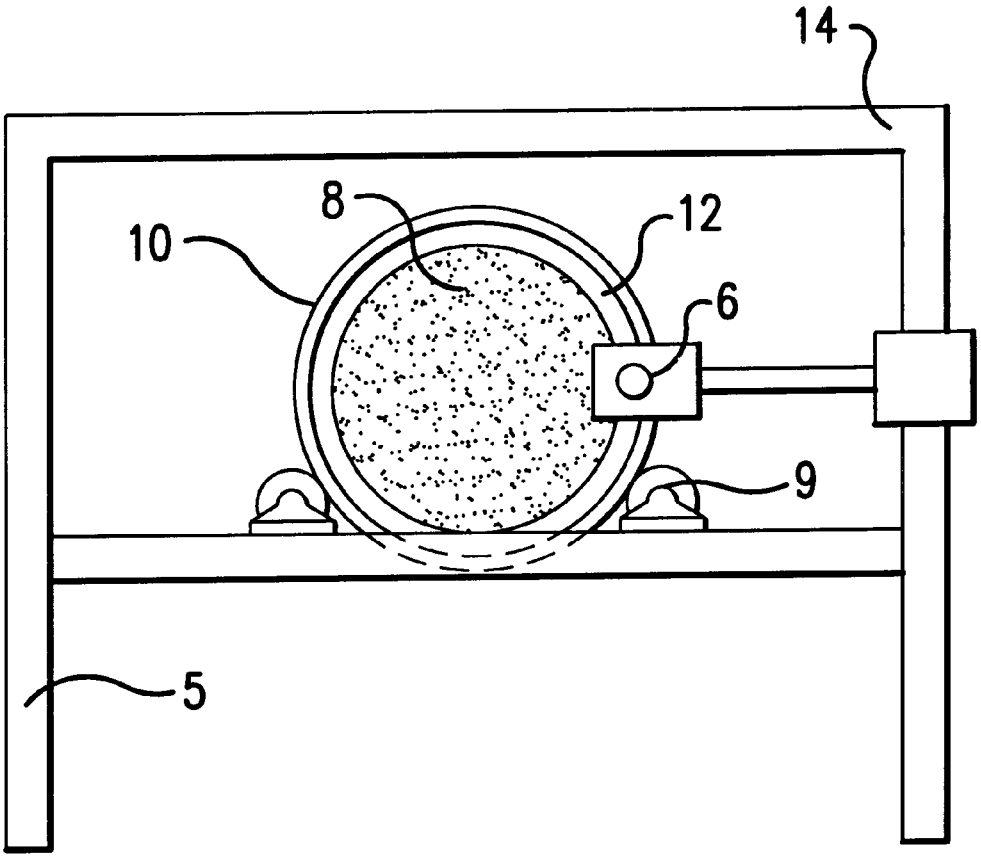
FIG. 2*a*) is an end side view of a body of composite rocket fuel mounted on drive rollers, with the nozzle arranged stationary.
Figure 2B:
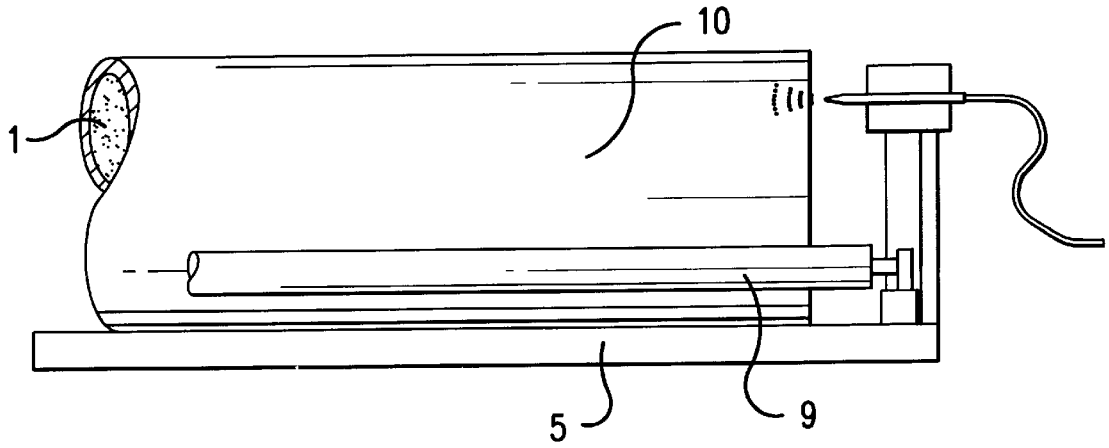
FIG. 2*b*) is a longitudinal side view of the arrangement of the arrangement of FIG. 2*a*).

FIG. 2*a*) shows a side end view of a body 8 of a composite rocket fuel of larger mass which is mounted, at its lower region, on two rollers extending in lengthwise direction, which are driven by a second drive device 9, the body 8 being contained in a casing which preferably consists of metal and extends over the length of the body 8. By the second drive device 9, the body 8 having the metal casing 10 is placed in rotation around its longitudinal axis. The nozzle holder 6 having a nozzle 7 for the high-pressure water jet 2 is so arranged on a frame 14 fastened to the chopping bench 5 that the jet of water strikes a region of the end 11 of the body 8 in accordance with FIG. 2*b*), which is present in ring form between the inside of the metal casing 10 and the outside of the body 8 of composite rocket fuel. By the fixing of the stationary nozzle 6 on the frame 14 of the chopping bench 5, the body 8 can be scooped out of the metal casing 10 by the high-pressure water jet 2 and thus be fed to a later division into portions in suitable manner. In the region between the outer cylindrical surface of the body 8 and the inner surface of the metal casing 10 there is a binder, so that upon the directing of the high-pressure water jet 2 into the intermediate region 12 formed by the binder, neither the metal casing 10 nor the composite rocket fuel 1 is cut.

In order, if necessary, to prevent a mixing of the composite rocket fuel with particles of metal from the metal casing 10 upon the chopping, the separating of the casing 10 without cutting the composite rocket fuel 1 is possible by a tangentially effected longitudinal cut.

By such a process and such an apparatus in accordance with the invention, it is possible to decompose or divide into portions different sizes of bodies 1 of composite rocket fuel with or without metal casing 10 and feed them to further disposal, for example, by burning in portions, in which case the cutting energy introduced with the high-pressure water jet 2 is led away, so that the danger of unintended igniting of the rocket fuel can be eliminated or greatly reduced. Furthermore, the device for the carrying out of the process of the invention can be remote controlled and the process itself can be used under conditions of normal ambient pressure in order to produce divided pieces of the composite rocket fuel of any desired size.

We claim:

1. A process for the chopping of a body of solid explosive into discrete sectional portions, comprising the steps of:

directing a high-pressure water jet emerging from a nozzle onto the body of solid explosive;

moving the nozzle and the body of solid explosive relative to each other during the step of directing; and continuing said steps of directing and moving until at least one discrete sectional portion is cut from a remaining sectional portion of the body of solid explosive.

2. The process of claim 1, wherein the body of solid explosive consists of composite rocket fuel.

3. The process of claim 1 or 2, wherein the high-pressure water jet contains abrasive particles.

4. The process of claim 2, wherein the nozzle is stationary and the body of composite rocket fuel carries out a chopping advance movement.

5. The process of claim 4, wherein the body of composite rocket fuel is in a metal casing, a binder being disposed between the metal casing and the body of composite rocket fuel, the process further comprising:

rotating the body of composite rocket fuel with the metal casing and the binder around a longitudinal axis thereof; and at the same time longitudinally directing the high-pressure water jet into a space containing the binder to cut the binder in order to scoop the body out of the metal casing in a solid form.

6. The process of any of claims 1, 2, 4, or 5, wherein chopping advance movements of the nozzle and/or of the body of composite rocket fuel as well as operating parameters of the high-pressure water jet are remote-controlled.

7. The process of claim 2, wherein the body of composite rocket fuel is stationary and the nozzle carries out a chopping advance movement.

8. The process of claim 4 or 7, wherein the chopping advance movement is carried out around at least two axes.

9. The process of any of claims 1, 2, 4 or 7, wherein the high-pressure water jet emerges from the nozzle with a pressure with the range of 30 to 120 MPa.

10. A process for the dividing into discrete sectionalized portions a body of solid explosive in which a high-pressure water jet emerging from a nozzle is directed onto the body of solid explosive, and the nozzle and the body of solid explosive carry out a movement relative to each other during the division into portions, wherein the body is divided up into the discrete sectionalized portions under ambient conditions without danger of ignition.

11. The process of claim 10, wherein the body of solid explosive is in a casing which is rotated around a longitudinal axis and at the same time the high-pressure water jet is directed in a ring shape between an inner side of the casing and an outer side of the body of solid explosive in order to scoop the body of solid explosive out of the casing.

12. The process of claim 10 or 11, wherein the high-pressure water jet contains abrasive particles.

13. The process of claim 10 or 11, wherein at least one of the nozzle and the body of solid explosive carries out a chopping advance movement around at least two axes.

14. The process of claim 13, wherein the chopping advance movement of the at least one of the nozzle and the body of solid explosive as well as the parameters of the high-pressure water jet are remote controlled.

15. The process of claim 10 or 11, wherein the high-pressure water jet emerges from the nozzle with a pressure within the range of 30 to 120 MPa.

* * * * *